US008282511B2

(12) United States Patent
Fatherree

(10) Patent No.: US 8,282,511 B2
(45) Date of Patent: Oct. 9, 2012

(54) BALL AND ELEVATED COURT SPORT

(76) Inventor: Ben Fatherree, Newport, KY (US)

( * ) Notice: Subject to any disclaimer, the term of this patent is extended or adjusted under 35 U.S.C. 154(b) by 0 days.

(21) Appl. No.: 12/924,829

(22) Filed: Oct. 6, 2010

(65) Prior Publication Data

US 2012/0088613 A1 Apr. 12, 2012

(51) Int. Cl.
*A63B 67/00* (2006.01)
*A63B 67/04* (2006.01)

(52) U.S. Cl. ..... 473/473; 273/317; 473/496

(58) Field of Classification Search ..... 473/435, 473/473, 475, 496; 273/342, 394, 402, 403, 273/404, 317

See application file for complete search history.

(56) References Cited

U.S. PATENT DOCUMENTS

| | | | | |
|---|---|---|---|---|
| 719,456 | A * | 2/1903 | Gaily | 273/342 |
| 3,144,841 | A | 8/1964 | Meringoff | |
| 3,452,985 | A * | 7/1969 | Zmura | 473/475 |
| 3,622,156 | A * | 11/1971 | Pugsley | 473/496 |
| 3,717,343 | A * | 2/1973 | Hartford | 473/475 |
| 4,108,434 | A | 8/1978 | Royer | |
| 5,655,979 | A | 8/1997 | Blue | |
| 6,379,273 | B1 * | 4/2002 | Takacs | 473/496 |
| 7,367,907 | B1 | 5/2008 | Sutton | |
| 2009/0191987 | A1 * | 7/2009 | Fleming et al. | 473/475 |

FOREIGN PATENT DOCUMENTS

JP 2001129140 A * 5/2001

* cited by examiner

*Primary Examiner* — Gene Kim
*Assistant Examiner* — M Chambers
(74) *Attorney, Agent, or Firm* — R. Christian Macke

(57) ABSTRACT

A multiple player team sport, rules and equipment combining features of volleyball, dodge ball, hand ball and table tennis. Two player teams are positioned opposite one another with multiple elevated playing surfaces between them. A tennis ball sized spheroid having a leather cover and resilient inner core for bounce is initially served by one team from one of its elevated playing surfaces toward and onto the opposing team's playing surface. The defending team may then strike the ball with any part of the body to return it, or it may be passed from one teammate to another to set up a kill shot onto either the opposing teams playing surface or by attempting to strike one of the opposing team's players. When the ball is not successfully returned, the last team successfully striking the ball is awarded a point. During play the ball may only be struck by a player's hand or body. The elevated playing surfaces are at least two relatively long opposed tables with provisions allowing players to approach the center line to be in positions for a kill shot, including rounded corners and tapered shapes to provide suitably large strike areas for the ball to be played onto while not restricting the players' ability to move forward and attack the opposing court.

12 Claims, 7 Drawing Sheets

BALL AND ELEVATED COURT SPORT

FIELD OF THE INVENTION

The present invention relates to a table top sport and equipment therefore combining aspects of volleyball, handball, dodge ball and table tennis.

BACKGROUND OF THE INVENTION

The most popular use of free time by people in the United States is as participant or spectator of games or sports. Whether playing backyard volleyball, billiards, or ping pong, attending a game between professional athletic teams, or attending a soccer game between four year olds, it is difficult to escape the presence of sports and games in our society.

Among the games and sports played at home, there are a number of table top games with well known specialized equipment that are played according to well known rules. Many of those games are played competitively, some even played professionally by very skilled players. Billiards, air hockey and table tennis, for example, are played in many homes, but there are also high stakes, professional billiards tournaments and international Olympic level table tennis tournaments that are of global interest.

Competitive sports, on the other hand, such as volleyball, basketball, tennis and racquetball, are typically played in large, gymnasium sized facilities or on large outdoor courts. In addition to being played in a different venue, sports generally involve more physical, athletic components of running, jumping, hitting or throwing than table top games played at home, which typically require hand-eye coordination, but little or no high exertion athletic running, jumping, hitting or throwing.

In the era of being healthy and physically fit, where the health benefits of participating in high exertion, physically demanding sports are well known as a way to stay healthy and physically fit, there is ample motivation to devise a physically demanding sport that may be played by most active persons but which incorporates many of the beneficial attributes a table top game played at home. A competitive and physically demanding sport that can be played at home will be advantageous over a home workout of aerobics or weightlifting to those that consider competitive sports and games more fun than a regimented workout.

It is desirable to provide a table top based game that incorporates more physical, athletic components than existing table top games, such as billiards and table tennis, but one that does not require a large facility such as a gymnasium to be played. The present invention addresses this need by providing a table top sport that is physically demanding, combining aspects of volleyball, handball, dodge ball and table tennis, while still being played on an elevated playing surface within the confines of a garage or basement in a typical home.

It is also desirable to provide a physically demanding table top sport with relatively simple equipment that may be transported from venue to venue. It is specifically contemplated that the present invention can be played by placing the table top courts on grass, asphalt, sand, pavement, hardwood and synthetic surfaces and that it may be played indoors or outdoors.

The present invention, one embodiment of which is gaining popularity under the name HANTIS®, is distinguishable from prior art table top games in that it combines team play aspects between a multiple player team, similar to volleyball wherein teams comprising between two and six players pass and set between teammates to set up "spike" or "kill" shots.

The present invention, however, is played with a ball smaller than a volleyball and on an elevated table top playing surface, similar to ping pong. However, the ball is generally the size and weight of a tennis ball, much larger and heavier than a ping pong ball, and the elevated table top playing surface is of a more heavy duty construction than a standard table tennis set to withstand the more demanding athletic play of running, jumping and diving players that are hitting a tennis ball sized projectile instead of a ping pong ball. The table tops of the present invention must withstand "spikes" or "kill" shots that are hit with force down onto the playing surface, as well as being able to withstand player collisions. A full appreciation of the athletic nature of the present invention, as well as the need for heavy duty table top surfaces, may be derived by viewing video available at the present inventor's website at www.hantis.net.

The equipment of the present invention includes a hollow, pressurized ball and, in the most preferred embodiment, four separate playing surfaces arranged and spaced apart to accommodate two opposing two-player teams. However, as set forth in more detail in the Detailed Description that follows, other numbers of teams and players are contemplated such that deviation from two opposing two-player teams does not deviate from the principles of the present invention. The playing surfaces are designed to allow players to attack the opposing team's courts to set up for a "kill" shot, similar to a spike in volleyball. The playing surfaces are constructed from sufficiently heavy gauge materials to withstand repeated "kill" shots and player collisions into the playing surfaces. Both the playing surface itself and the supporting structure must be of heavier, sturdier construction than a conventional table tennis set and designed to withstand a more athletic sport played with a heavier ball.

The rules of the present invention game set forth in more detail herein combine, in addition to volleyball and table tennis, aspects of handball and dodge ball because a player may elect, instead of playing a shot directly at the other team's playing surfaces, to be off of a wall or directly at the opponent, whereupon the opponent must return it or dodge the ball. The rules provide that a shot that hits an opponent's body without hitting a table top or the ground is a live shot that must be returned; if it is not successfully returned, the team hitting the "body shot" receives a point.

The elevated playing surfaces of the present invention are also provided with tilt adjustment so that the table tops can be inclined at an angle. By adjusting the table top angle, the angle of incidence at which the ball strikes the table top will change, so the reflective angle, and time in which the defender has to return the shot, changes. That is, a very hard and flatly struck "kill" shot will bounce up at a greater angle, giving the defender a greater opportunity to return it, than if the table top had been flat, i.e. parallel to ground.

The equipment of the present invention comprises the ball and playing surfaces mentioned above for use with an athletic, physically demanding sport wherein players use speed, agility and strength to run, jump and strategically strike the ball in a way that prevents the opponent from returning it. In terms of its physically demanding nature, the present invention is similar to volleyball, dodgeball and racquetball/handball, but as far as the equipment and venue necessary to play, it resembles table tennis. In one specific aspect of the present invention, the heavy duty table top playing surfaces comprise rigid, stable supporting structure that is collapsible to make the playing surfaces portable. Such a playing surface design, along with rules allowing players to strike the ball from anywhere, results in a fun and athletic sport wherein an infinite number of plays and shots are possible.

OBJECTS OF THE INVENTION

It is an object of the present invention to provide a table top sport that is physically demanding.

It is another object of the present invention to provide a table top sport combining aspects of volleyball, handball, dodge ball, and table tennis.

It is yet another object of the present invention to provide an athletic, physically demanding table top sport that may be played in a home.

It is another object of the present invention to provide a table top sport utilizing a tennis ball sized projectile without paddles.

It is yet another object of the present invention to provide rules and equipment for a table top sport.

It is yet another object of the present invention to provide equipment for a table top sport comprising separate playing surfaces for each of at least four players designed to accommodate players attacking the opponents with kill shots hit downwardly with force onto the opposing playing surfaces.

It is yet another object of the present invention to provide a table top sport in which multiplayer teams may pass or set the ball between players before returning it to the opposition.

It is another object of the present invention to provide a table top sport for multiplayer teams wherein the angles of the table top playing surfaces are adjustable to change the angle of the incidence and reflection of the ball thereon.

It is yet another object of the present invention to provide a table top sport for multiple multiplayer teams wherein heavy duty table top playing surfaces are provided with rigid, stable supporting structure that is collapsible such that the table top playing surfaces are readily transportable and may be positioned on grass, asphalt, sand, pavement, hardwood or synthetic surfaces.

It is yet another object of the present invention to provide a table top sport in which opposing multiplayer teams alternately receive and return a ball to an opposing team, wherein the players are free to move among around the opponents and opponent playing surfaces to strike the ball.

SUMMARY OF THE INVENTION

The present invention comprises a game set having multiple elevated contact surfaces separated into four courts, a spherical projectile that is alternately struck by opposing multiple player teams and returned to the opponent. A set of rules is provided governing arrangement of the multiple contact surfaces and actions of the players such that players may approach an opposing court assigned to an opposing team and strike the projectile from in front of, behind any of the four courts. The multiple elevated contact surfaces are constructed from sturdy table tops elevated above ground by heavy stable supporting structure to accommodate athletic play with a heavy ball.

In the preferred embodiment of the present invention, the spherical projectile comprises a hollow, pressurized spheroid with resilient shape and bounce characteristics, generally to be roughly the size and shape of a tennis ball.

The most preferred embodiment of the present invention comprises four elevated contact surfaces on four separate table tops, a spherical projectile, and a rule set providing for two teams having at least two players. According to the rules of the present invention, play is initiated when one of the players serves the spherical projectile from his playing surface to one of his opponent's playing surfaces. After the serve, the players are unrestricted as to location from which they may strike the projectile. Further, the present invention comprises a sport wherein the four elevated surfaces are of heavy duty construction and structure supporting such is of sufficient rigidity to withstand athletic play. Arrangement of the playing surfaces allows players to move freely in and around them so that players may strike the ball from positions in front of, beside and behind any of the elevated surfaces.

The elevated contact surfaces are provided with tapered shape and rounded corners, and the rule set provides that, after the serve, the players may attack their opponents by hitting the projectile at the opposing courts, passing it to a teammate, or hitting it directly at an opponent. The equipment and rules provide that a player may attack from anywhere and may even use environmental aspects such as walls, ceilings, nearby trees, etc. The elevated contact surfaces are supported by bright adjustable supporting structures having telescoping and lockable legs that allow height and tilt adjustment of the playing surfaces.

DETAILED DESCRIPTION OF THE INVENTION

Figure 1:
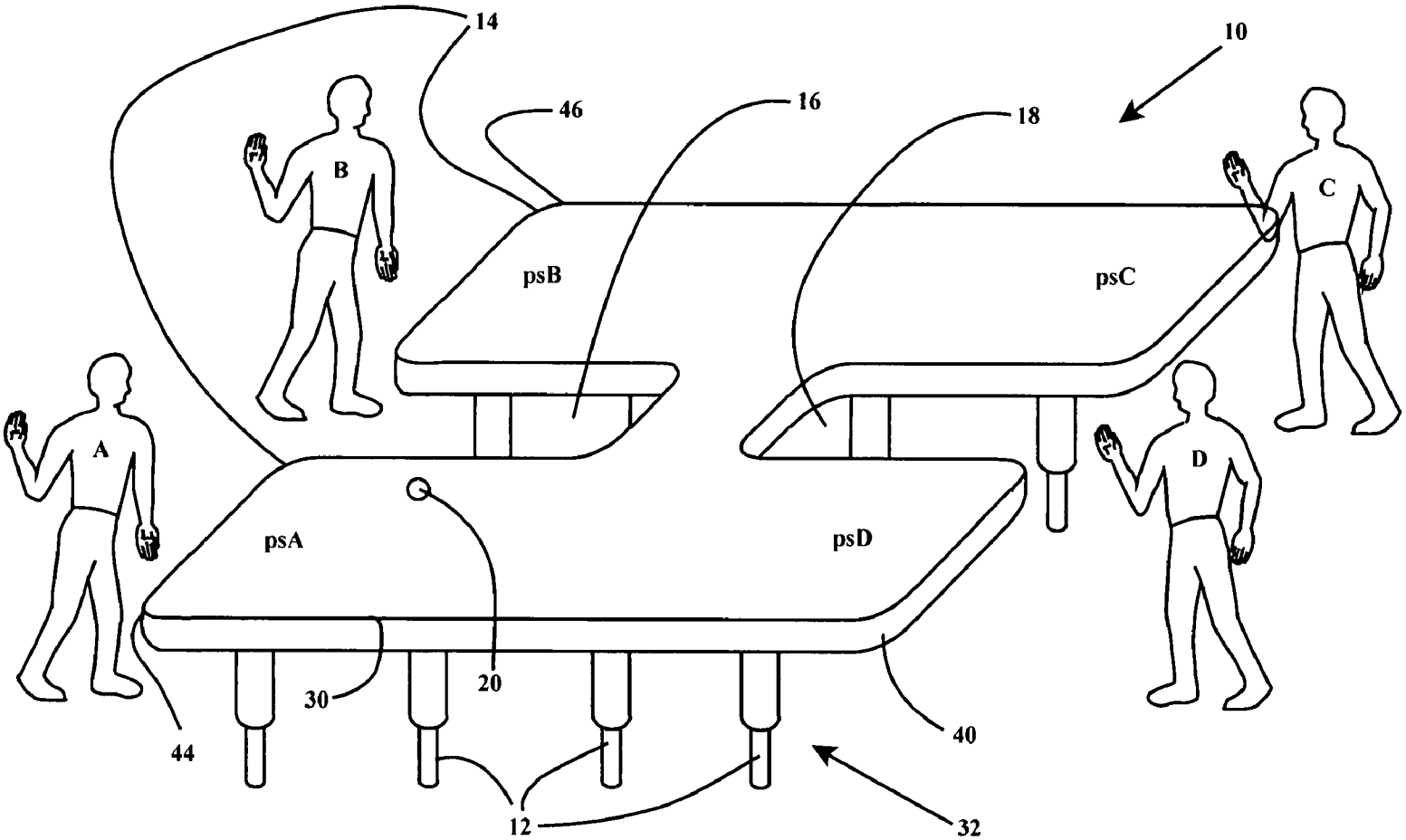
FIG. 1 is a perspective view of a single playing surface of the present invention.

As a preliminary matter, it will readily be understood by one having ordinary skill in the relevant art ("Ordinary Artisan") that the present invention has broad utility and application. Furthermore, any embodiment discussed and identified as being "preferred" is considered to be part of a best mode contemplated for carrying out the present invention. Other embodiments also may be discussed for additional illustrative purposes in providing a full and enabling disclosure of the present invention. Moreover, many embodiments, such as adaptations, variations, modifications, and equivalent arrangements, will be implicitly disclosed by the embodiments described herein and fall within the scope of the present invention.

Accordingly, while the present invention is described herein in detail in relation to one or more embodiments, it is to be understood that this disclosure is illustrative and exemplary of the present invention and is made merely for the purpose of providing a full and enabling disclosure of the present protection. The detailed disclosure herein of one or more embodiments is not intended, nor is to be constructed, to limit the scope of patent protection afforded the present invention, which scope is to be defined by the claims and the equivalents thereof. It is not intended that the scope of the patent protection afforded the present invention be defined by reading into any claim a limitation found herein that does not explicitly appear in the claim itself.

Thus, for example, any sequence(s) and/or temporal order of steps of various processes or methods that are described herein are illustrative and not restrictive. Accordingly, it should be understood that, although steps of various processes or methods are not limited to being carried out in any particular sequence or order, absent an indication otherwise. Indeed, the steps in such process or methods generally may be carried out in various different sequences and orders while still falling within the scope of the present invention. Accordingly, it is intended that the scope of the patent protection afforded the present invention is to be defined by the appended claims rather than the description set forth herein.

Additionally, it is important to note that, as used herein, "a" and "an" each generally denotes "at least one," but does not exclude a plurality unless the contextual use dictates otherwise. Thus, reference to "a picnic basket having an apple" describes "a picnic basket having at least one apple" as well as "a picnic basket having apples." In contrast, reference to a "picnic basket having a single apple" describes "a picnic basket having only one apple."

Furthermore, it is important to note that, as used herein, "a" and "an" each generally denotes "at least one," but does not exclude a plurality unless the contextual use dictates otherwise. Thus, reference to "a picnic basket having an apple" describes "a picnic basket having at least one apple" as well as "a picnic basket having apples." In contrast, reference to "a picnic basket having a single apple" describes "a picnic basket having only one apple."

When used herein to join a list of items, "or" denotes "at least one of the items," but does not exclude a plurality of items of the list. Thus, reference to "a picnic basket having cheese and crackers" describes "a picnic basket having cheese without crackers", "a picnic basket having crackers without cheese", and "a picnic basket having both cheese and crackers." Finally, when used herein to join a list of items, "and" denotes "all of the items of the list." Thus, reference to "a picnic basket having cheese and crackers" describes "a picnic basket having cheese, wherein the picnic basket further has crackers," as well as describes "a picnic basket having crackers, wherein the picnic basket further has cheese."

The present invention comprises a sport, including the playing surfaces, equipment and rules thereof, that has evolved through several permutations and is now popularly played and referred to as HANTIS®. It is an athletic, intense and physically demanding sport played on table top playing surfaces and is well depicted and illustrated, in addition to the following detailed description, at www.hantis.net.

The present invention comprises equipment and rules for a table top sport combining aspects of volleyball, handball, dodge ball and table tennis. It is played on an elevated table top playing surface, 10 which may be positioned from zero (0") inches to forty-two (42") inches above the ground, depending on the skill and height of the players, by providing appropriate supporting legs 12 around the periphery of the playing surface 10.

The supporting legs 12 may be positioned and spaced in an infinite number or arrangements to support the playing surface 10, but it is critical that both the playing surface 10 and supporting legs 12 (or other support structure) must be adequate to withstand athletic play, player collisions, and sharply struck "kill" shots that occur within the ordinary play of the present invention. Standard table tennis sets, typically comprising hollow aluminum support structure and ¼ inch sheeting, are inadequate for the rigors of the present invention. In addition, the standard table tennis lacks the rounded corners 14 and attack alleys 16, 18 of the present invention (see FIG. 1). The importance of those design features will be described in more detail herein.

The playing surface 10 of the present invention comprises four playing surfaces psA, psB, psC, psD, each assigned to one of the four players A, B, C, D. As shown in FIG. 1, a team AB comprising players A and B is opposed by a team CD comprising players C and D. As described in more detail in the following rules, one of the members of team AB initiates play by striking the projectile 20. In the most preferred embodiment, the projectile 20 comprises a spheroid roughly the size, shape and composition of a tennis ball, although other projectiles that provide similar action on the table top playing surface of the present invention may be used without departing from the projectile of the present invention. Play begins with team AB serving, trying to either land the ball in one of the opponents' playing surfaces psC, psD or to strike one of the opponents C,D with the ball 20 before it hits the ground. If either of those events occur, i.e. the ball strikes the playing surface psC or psD or the players C or D, then it must be returned by team CD or else team AB is awarded a point.

During play, the projectile 20 may be struck by any part of a player's body to return it or to pass it to his teammate, but no paddle or racquet is or may be used according to the rules of the present invention. Typically, the player uses his hand to strike the projectile 20 to maximize control and force, but the projectile may also be kept in play by striking it with the head, arms, torso, legs, feet or any other body part of the body. No paddles or racquets are used in the present sport because small hand held paddles, such as used in table tennis, are insufficient in size and structure for use with a tennis ball type projectile 20. Racquets, on the other hand, such as those used in racquetball and tennis, are too large for use within the relatively modest dimensions of the present table top sport.

Figure 2:
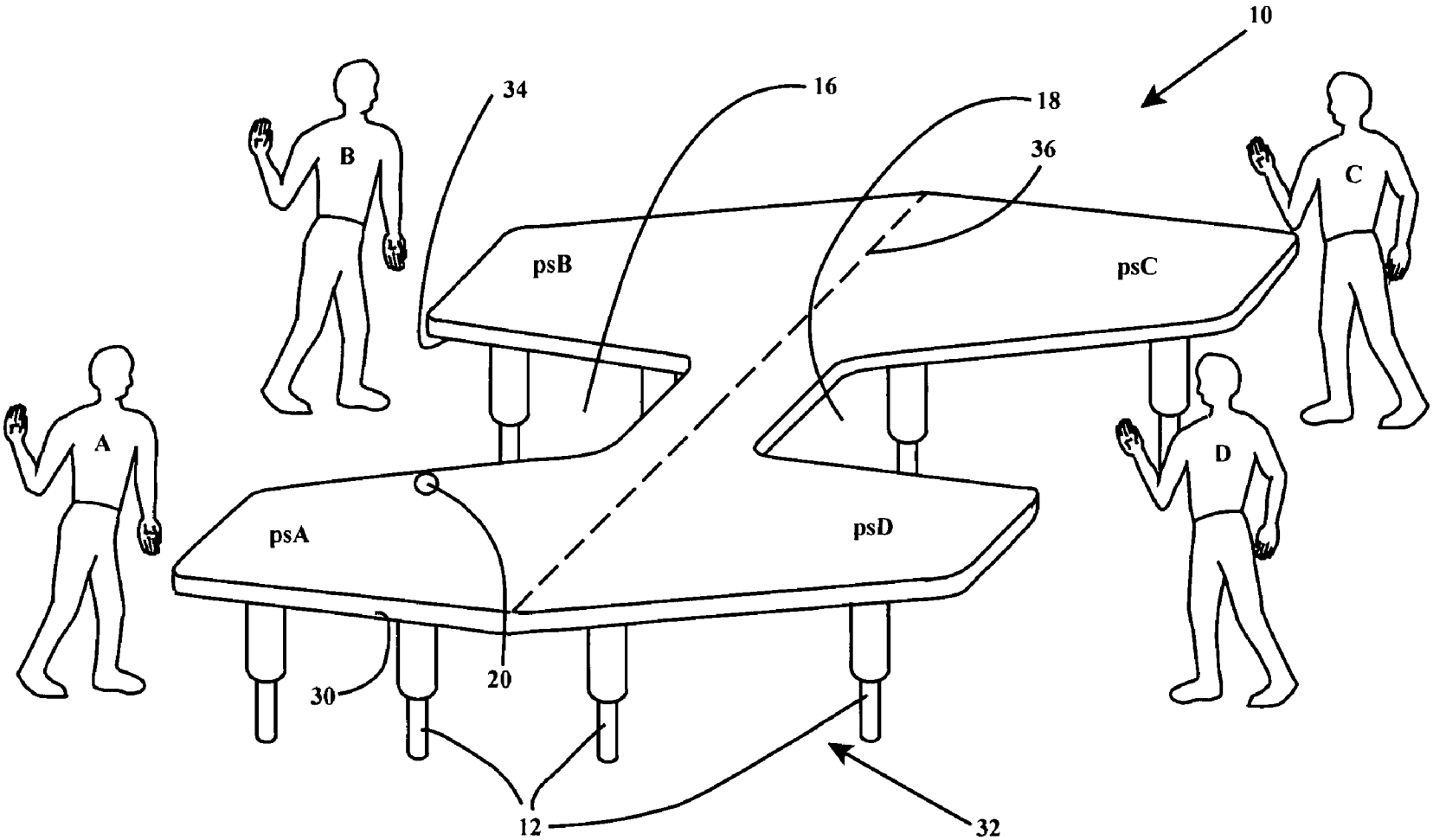
FIG. 2 is a perspective view of a single playing surface of the present invention wherein the playing surfaces are tapered.

In a first embodiment of the present invention, shown in FIG. 1, and a second embodiment of the present invention, shown in FIG. 2, the playing surface 10 comprises a single sheet 30 of playing surface material supported on structure 32 comprising multiple a plurality of legs 12 mounted to the underside 34 of the sheet 30, near the periphery of the sheet 30.

Figure 4:
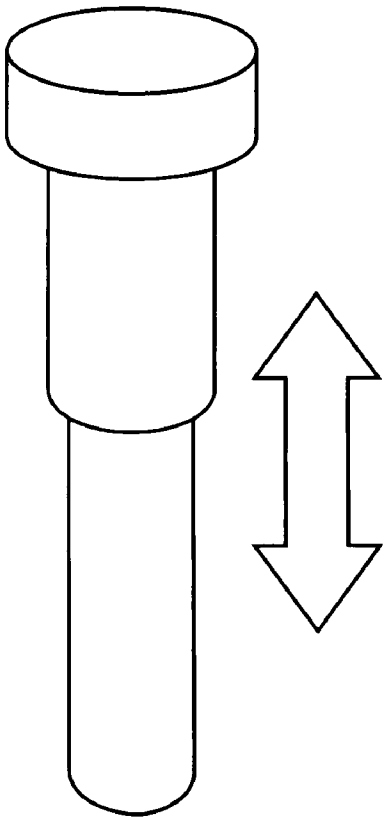
FIG. 4 is a schematic representation of a telescoping leg allowing for height adjustment and tilt of the playing surfaces.

To allow for players of different ages and heights to play the present invention, the supporting structure 32 is height adjustable. In the most preferred embodiment, the legs 12 are telescoping and lockable (see FIG. 4) to allow the height of the playing surface 10 to be adjusted and maintained for players of different heights. Each of the plurality of legs 12 are height adjustable independent of the other legs 12, so the playing surfaces psA, psB, ps,C, psD may also be provided with a tilt. This is important because, as will be discussed in more detail, changing the angle of the playing surfaces psA, psB, psC, psD changes the angle of incidence and angle of reflection of the ball 12. Generally, this will provide an advantage to the defender because, if a player plays the ball into his opponents court from his side, the ball will hit a playing surface psA, psB, psC or psD, and be reflected upwardly (see FIG. 6, giving the defenders more time to return the shot. Although other devices and arrangements for making the playing surface 10 height adjustable may be used without departing from the principles of the present invention. This provision allows for tilt of the playing surfaces psA, psB, psC, psD to change the angles upon which the ball strikes and is reflected from the playing surface.

Further, the supporting structure 32 is also collapsible and retractable to be concealed within the table top playing surfaces psA, psB, psC, psD so that the game's "court" may be transported and relocated virtually anywhere, on surfaces such as sand, asphalt, grass, hardwood, or synthetic surfaces.

In the embodiments of the present invention shown in FIGS. 1 and 2, attack alleys 16, 18 are provided in the playing surface 10 that allow players A, B, C, D to attack the opponents courts and to play shots from in front of, beside or behind the opposition court.

The four courts psA, psB, psC, psD make up opposing sides of the playing surface, psA and psB comprising one side and psC and psD comprising the other side. In the most preferred embodiment of the present invention, four players A, B, C, D comprise two teams, A and B on a first team and C and D on a second team, with playing surfaces psA, psB assigned to the first team and playing surfaces psC, psD assigned to the second team. Pursuant to the rules, the team into whose side a ball is played must make the first contact with the projectile to return it. A player may strike the projectile 20 with any part of his body to return it to one of the opposing courts, or he may hit it directly at an opposition player, or he may pass it to his teammate, each player being permitted to hit the ball twice before returning. If the projectile 20 either strikes an opponents' playing surface or the opponent and then hits the ground, the offensive team scores a point.

As an example, the projectile 20 is played into player A court psA. The rules of the present invention set forth in more detail herein, permit each player to strike the ball twice while it is in his team's possession, and the ball may be played onto each player's table once during a possession. Thus, during a possession a team may strike the projectile four times (though no more than two times per player) and have it bounce off of both tables. However, one of the two permitted table hits will generally be used on the shot wherein possession changed, e.g. when team AB returns the ball to player C by hitting the ball onto court psC, team CD may not then play a shot back onto that court psC before the projectile 20 is returned. Player A may either pass it to himself (he may only do this once), pass it to his teammate B, or direct a shot at either opponents' courts psC, psD or directly at his opponents C, D. If he elects to pass to his teammate B, player A may "set" the ball so that teammate B moves forward into the attack alley 16 to hit a "kill" shot either down onto on opposition court psC, psD or at an opponent C, D. If player A passes the projectile to player B, then player B may either play the projectile 20 onto the opposition courts psC, psD, directly at the opponents C, D, or he may pass it back to his teammate player A if player A has not used both hits during his team's possession.

The equipment and rule set of the present invention provide a sport requiring speed and agility, as well as hand-eye coordination. While serve and volley shots may be played similar to table tennis, the arrangement of the playing surfaces psA, psB, psC, psD and the rules, which permit a player to hit a shot or make a pass from anywhere, create a fast-paced, high activity athletic contest.

The present invention comprises a table top sport wherein a first team of two players A,B alternatively strike the projectile 20 in an effort to either land it on the opponents' playing surfaces psC, psD or hit the opponents C,D with the projectile in a way that makes it difficult or impossible for the opponents C,D to return the ball. If the attacking team A,B is successful, it is awarded a point. After a serve initiating play, the player striking the ball may do so from anywhere, including next to or behind his opponent's playing surface. That is, it is within the rules and frequently occurs that player A may strike the projectile 20 while next to or behind opposing player C when he receives a pass from his teammate, player B. Player A may then play a shot onto the opposition playing surfaces psC, psD or he may play it directly at player C or player D or he may pass to his teammate if the number of hits allows. The design of the playing surface 10 reflects the dual motivations to provide a table top playing surface onto it, while minimally restricting players' ability to move around it. As such, the playing surface 10, in the embodiment shown in FIGS. 1 and 2, has "attack alleys" 16,18 formed therein allowing players to charge at their opponents for "kill" shots, and the corners 40, 42, 44, 46 of the playing surface 10 are rounded to prevent players from crashing into sharp corners.

Figure 5A:
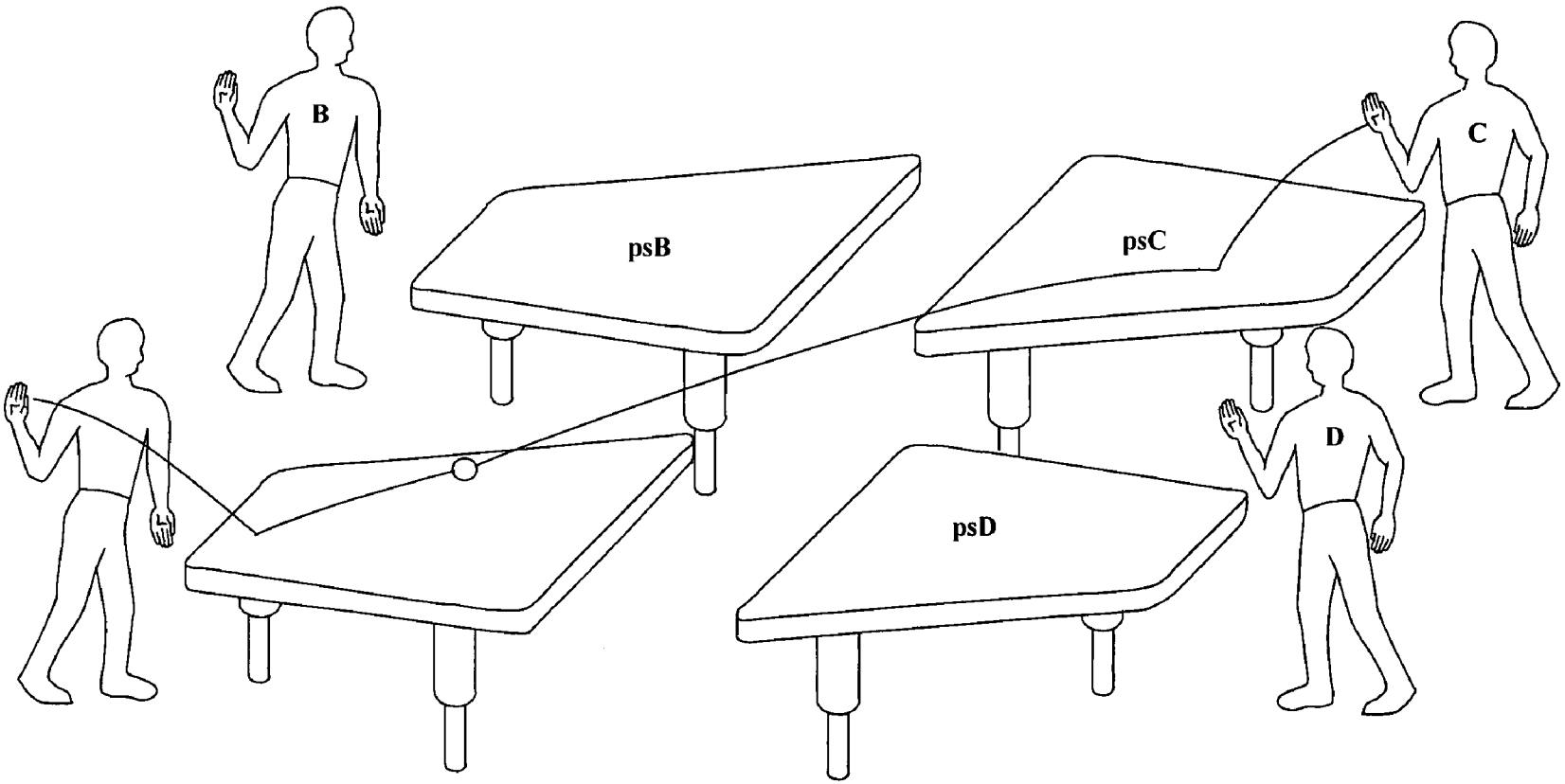
FIG. 5 A, B, C is a schematic representation of a permitted play according to the rules between teammates.
Figure 5B:
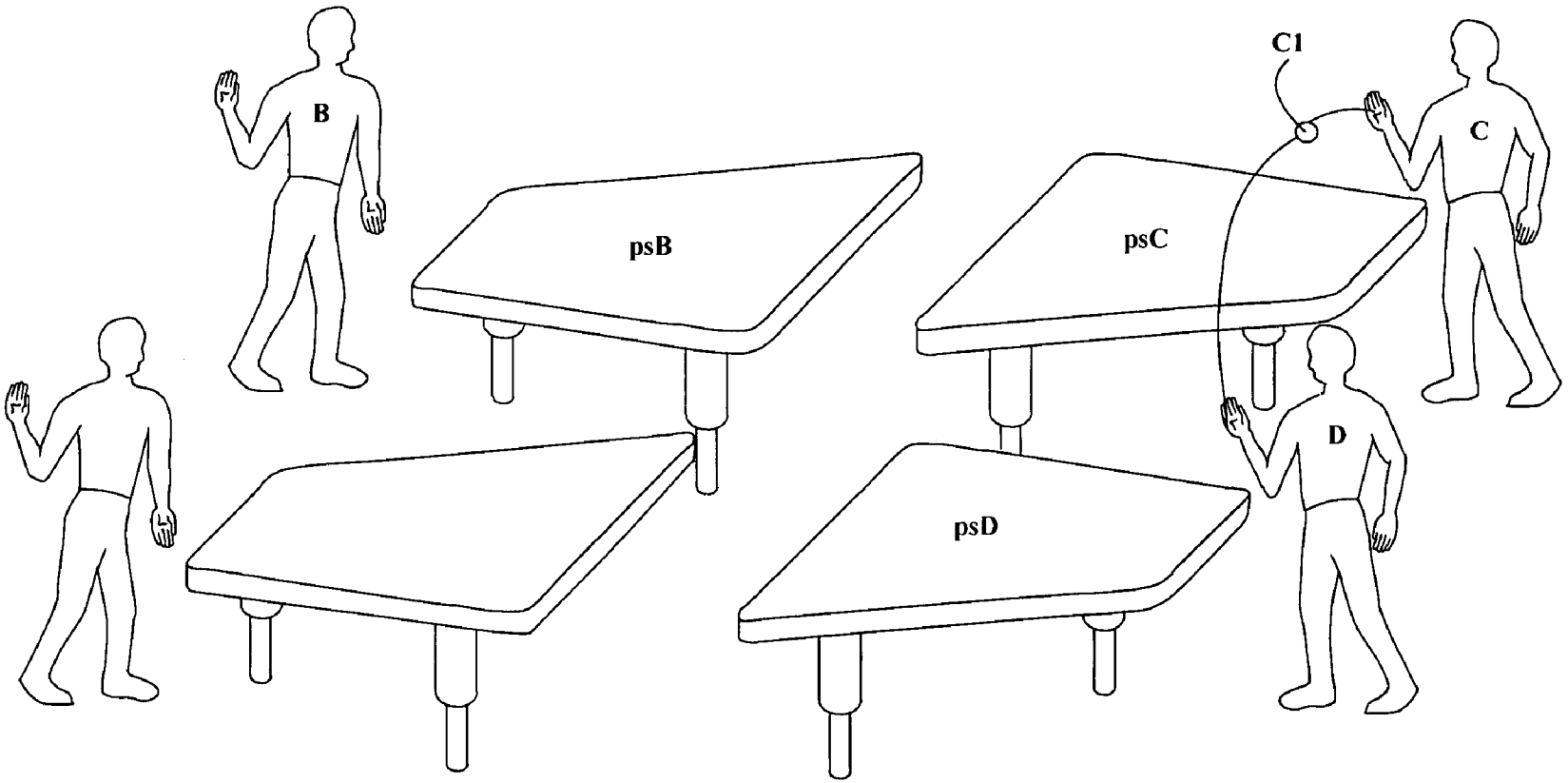
Figure 5C:
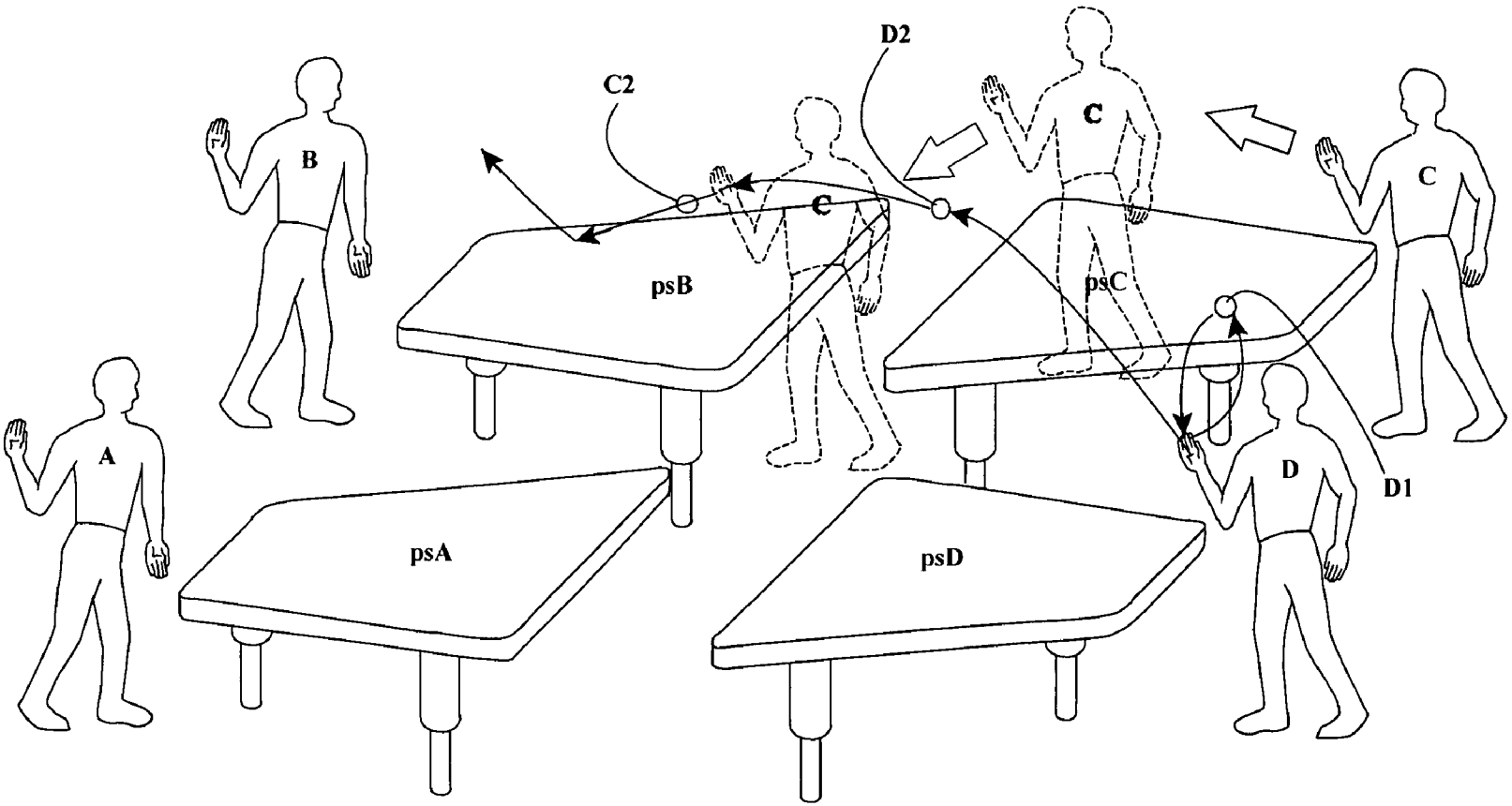

In the example set forth in FIG. 5A, play begins with player A serving the ball 20 across playing surface psA, onto playing surface psC, toward player C. As illustrated in FIG. 5B, player C than passes the ball to his teammate, (shot C1) player D. Player C then moves forward toward the opposition playing surfaces psA, psB, as shown in FIG. 5C. In the same example, player D then passes it to himself (shot D1) then passes it to his teammate player C (shot D2) near the opposition playing surfaces psA, psB, whereupon player C hits a kill shot (shot C2) onto playing surface psA as shown at FIG. 5C.

In addition, as shown in FIG. 2, the playing surface 10 is designed with generally tapered shapes for the four courts psA, psB, psC, psD, with the smaller end nearer the player assigned to such playing surface, the large end nearer his opponent. That is, player A court psA, as shown in FIG. 2, is wider near the opposition court psD and narrower near the serving position. This tapered shape of the playing surfaces psA, psB, psC, psD is important because it still provides a large surface onto which the ball 20 may be played, while minimizing the width near the serving end to cut down on the interference with player movement. The separate playing surfaces 50, 52, 54, 56 also have tapered and trapezoid shapes to provide a width portion 62 positioned near the opponent and a narrow portion 64 to allow maximum player movement among the playing surfaces 50, 52, 54, 56 while still providing a relatively large area onto which shots may be played. It is a critical design feature of the playing surfaces 50, 52, 54, 56 that the narrow ends of the trapezoidal shaped playing surfaces psA, psB, psC, psD are at opposite ends from the opponent, with the wider ends being positioned next to opposition playing surfaces as shown in FIG. 3.

As with other embodiments, the corners 70, 72, 74, 76 surface are rounded to minimize damage to the equipment and the players that result from players running into the playing surfaces 50, 52, 54, 56. The rounded corners 40, 42, 44, 46 and tapered playing surfaces psA, psB, psC, psD comprise critical features of the present invention recognizing that the players A, B, C, D may move around the playing surface 10 to play or return shots.

Figure 3:
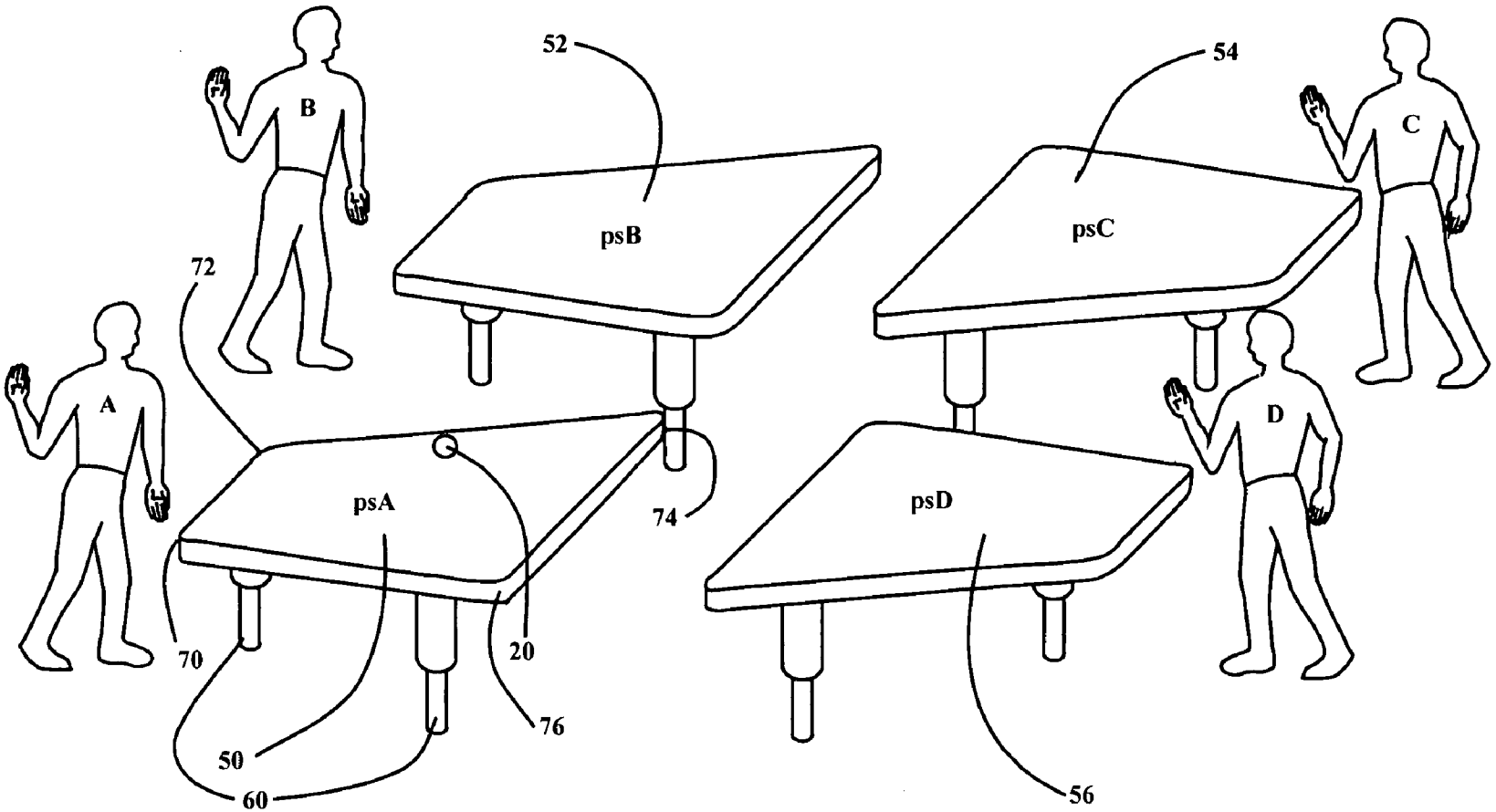
FIG. 3 is a perspective view of the preferred embodiment of the present invention wherein multiple separate playing surfaces assigned to the four players comprises the playing surface.

In the most preferred embodiment of the present invention, shown in FIG. 3, the playing surfaces psA, psB, psC, psD each comprise a stand alone table top 50, 52, 54, 56, each supported by legs 60 secured to the underside of the playing surface. As with the other embodiments discussed herein, the table tops 50, 52, 54, 56 are sufficiently sturdy, and the legs 60 sufficiently strong to withstand the active play, including repeated "kill" shots and player collisions. In the most preferred embodiment of the present invention, three telescoping legs 60 are provided on each playing surface 50, 52, 54, 56 and the playing surfaces 50, 52, 54, 56 each comprise at least a half inch thick slab sitting on top of legs 60 that are on aluminum or steel composite made to withstand 600 pounds of force.

Figure 6:
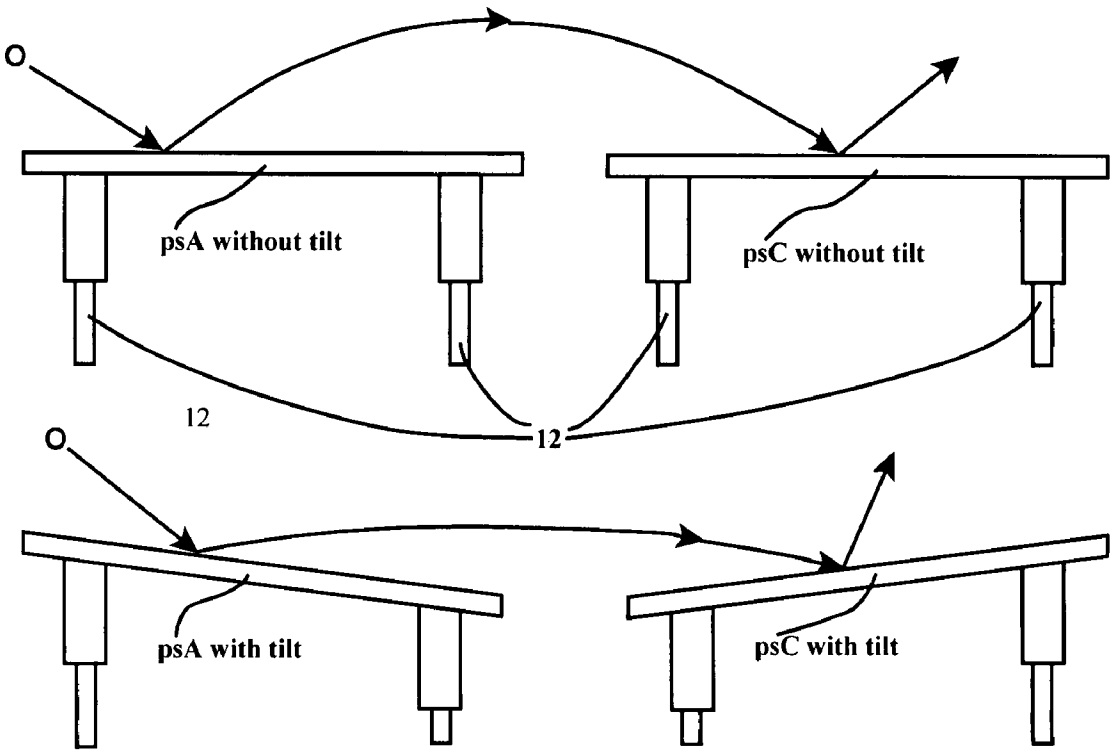
FIG. 6 is an elevation view illustrating the angled arrangement of playing surfaces psA and psC.

By providing the independently adjustable legs 12 the playing surfaces psA, psB, psC, psD may be tilted as shown in FIG. 6, with the side nearest the opponent at a low elevation. This arrangement results in a greater angle of reflection for a shot from opponent's side, giving the defensive player a greater opportunity to return the shot. However, it also provides an opportunity for a risk taking, aggressive player that is willing to move near, or behind the opposition playing surfaces, because they will have a shallower angle for a shot hit from behind the opposition' playing surface, making the shot much more difficult to return.

The rules of play for the present invention are as follows:

Lines of Scrimmage

1—OFFENSIVE. The offensive line of scrimmage is the line that must not be crossed by an offensive player's waist until the ball is deemed live by the live ball rule. The line is located parallel and in conjunction to the line formed by the offensive tables' apexes. It runs infinitely to the left, right, up and down. The line can be drawn on the floor of the game space or straight tape can be placed in order to prevent confusion by both the officials and players. After the ball is deemed live during a play, the offensive line of scrimmage is no longer active. If an offensive player passes the offensive line of scrimmage after the teams have set and before the ball is live, a point is rewarded to the opposing team; there is no replay of that point.

2—DEFENSIVE. The defensive line of scrimmage prevents players from getting too close to the other team prior to the serve, the line is located parallel and in conjunction to the line formed by the far/blunt sides of the defenses' tables. It also runs infinitely to the left, right, up and down. The line can be drawn on the floor of the game area or straight tape can be placed on the floor in order to prevent confusion by the officials and players. After the ball is deemed live during a point of play, the defensive line of scrimmage is no longer active. If a defensive player passes the defensive line of scrimmage after the team have set and before the ball is live, a point is rewarded to the opposing team; there is no replay of the point.

The Edge Rule

During play, the ball may hit the edge of a table. Immediately after leaving the table's edge, the ball will either go up, down, or horizontal. This rule explains the consequences of each of these possible outcomes.

1. The ball does NOT completely cross the edge of the table.
   - A. If the ball goes UP after hitting the edge of a table, the ball is played live, just as it would be if it were hit on the table's surface.
   - B. If the ball goes DOWN or HORIZONTAL after hitting the edge of a table, the ball is still live, however the hit on the table does not count.
2. The ball does completely cross the edge of the table.
   - C. If the ball goes UP, DOWN or HORIZONTAL after hitting the edge of a table, the ball is live, just as it would be if it were hit on the table's surface, Change of Possession Possession changes when the ball strikes a table surface or a person's hand, body, or uniform from one team to the next. A change of possession happens in only these instances.

1. The ball hits a player on Team A, and then hits a player or table on Team B.
2. The ball hits a table on Team A, and then hits a player or table on Team B.
3. The ball hits a table/player on Team A, bounces off a wall, and then hits a player or table on Team B.

The 2 Hit, 1 Hit Rule

Each player can have a maximum of two body hits per possession. This is known as the 2 Hit Rule. The team can have 1 hit on each table per possession. This is known as the 1 Hit Rule. Every time a team has possession of the ball, the players thus have combined body hit allowance of four (2+2) and a combined table hit allowance of 2(1 per table) per possession.

1. This rule always includes the hit that cause the change of possession.
2. The 2 Hit Rule and 1 Hit Rule is always as long as the ball is live.
3. A body hit and table hit CANNOT be combined as one hit.

Double Hand Hit

When a player hits the ball with two hands or wrists touching. This counts as 2 hits.

Uniform Interference

When a player intentionally uses their clothing to change the direction of the ball. The ball is called "dead" and a point is rewarded to the other team.

Live Ball

A live ball is started immediately when the serving player has struck the ball on his/her own table in attempt to serve. The ball then stays live, until a point is scored or foul is committed. Only then, does the ball cease to be "live".

Dead Ball

A dead ball occurs after a live ball when a point is scored or foul is committed and lasts until the ball is served again. The ball is dead when it:

1. Hits the ground,
2. Strikes a player's hand, body, or uniform three times in one possession.
3. Strikes a table twice in one possession.
4. Rolls on a table or a player.
5. Stops moving on a table or on part of the arena's environment.
6. Cupped by a player (held in the hand).
7. A foul is called by the regulator. See penalties.

Scoring—Points, Outs

Now that we understand what a live and dead ball are we can now use them in context. Scoring is kept two different ways, depending on the type of play. In tournament play, points are scored. In freestyle play, outs happen. Scoring happens only when a ball goes from being "live" to "dead". Here are explanations and illustrations of every way a ball can go from being "live to dead".

1. The ball is live, a player hits it, it hits the ground. The ball is dead.

The last person to hit the ball before it hits the ground is out, the other team gets a point.

2. The ball is live, it hits a table twice, it hits the ground. The ball is dead.

Since the ball last played on the table before striking the floor, the position holder of the table is out, the other team receives a point.

3. The ball is live, it hits a table twice. The ball is dead.

The player whose table was hit twice is out, the other team receives a point.

4. The ball is live, it hits a table and rolls on it, the ball is dead.
   The player whose table the ball rolled on is out, the other team receives a point.
5. The ball is live, during one team possession, a player hits it a third time. The ball is dead.

This can occur if the player hit the ball three times simultaneously or back and forth with his teammate. As long as that team kept possession of the ball and a player hit it three times, he/she is out, the other team receives a point.

The ball is live, it rolls on a player. The ball is dead.

Since the ball must always be struck/hit, the ball rolling on a player's body is an out, the other team receives a point.

6. The ball is live, it hits a table and stop completely. The ball is dead.

When the ball stops on a player's table, that player is out, the other team receives a point.

7. The ball is live, a player attempts to hit the ball—cupping the ball in hand or body. The ball is dead.

The ball must always be struck/hit, the player cupping the ball (holding it in hand or with clothing) is out, the other team receives a point.

8. The ball is live, hits a player, stops completely on an x-factor, the ball is dead.

When the ball stops on an object other than the four tables, the player who hit the ball last is out, the other team receives a point.

9. The ball is live, bounces off a table, stops completely on an x-factor. The ball is dead.

Since the ball is dead once it stops, the player whose table was hit last would be out, the other team receives a point.

I claim:

1. An elevated court sport set comprising:

four elevated interconnected contact surfaces on four table tops assigned to opposing multiple player teams;

a heavy tennis ball type spherical projectile struck only by player hands and bodies;

wherein said multiple contact surfaces are adequate to withstand athletic play, player collisions and sharply struck kill shots of said heavy tennis ball type spherical projectile, said contact surfaces being arranged such that a player can approach an opposing court assigned to an opposing multiple player team and is minimally restricted when approaching an opposing court, opposing court, wherein said four elevated contact surfaces are tapered to form a trapezoidal shape and arranged such that the smaller end is nearer the player assigned to said surface, the larger end is nearer to the opponent and wherein said four elevated contact surfaces are designed to allow said players to move freely in and around them such that players may strike the projectile from positions in front of beside and behind any of the four elevated contact surfaces.

2. The elevated court sport set as set forth in claim 1 wherein said multiple elevated contact surfaces further comprise table tops adequate to withstand kill shots of said heavy tennis ball type spherical projectile and frequent player collisions with said table tops, said table tops being elevated above ground supporting structures of heavier and sturdier construction than a conventional table tennis set and said table tops are arranged to provide attack alleys therebetween allowing a player to go between or to the side of said table tops to charge toward a table top assigned to the opposing team.

3. The elevated court sport set as set forth in claim 1 wherein said heavy tennis ball type spherical projectile comprises a hollow, pressurized spheroid with resilient shape and bounce characteristics.

4. The elevated court sport set as set forth in claim 3 wherein said spheroid is the weight size and shape of a tennis ball.

5. An elevated court sport set comprising:

four elevated contact surfaces on four separate table tops;

a heavy tennis ball type spherical projectile struck only by player hands and bodies;

wherein each of two teams having two players each is assigned two of said four elevated contact surfaces, and wherein said players are unrestricted as to location from which they may strike said heavy tennis ball type projectile, wherein said four elevated contact surfaces are tapered to form a trapezoidal shape and arranged such that the smaller end is nearer to the opponent and wherein said four elevated contact surfaces are designed to allow said players to move more freely in and around them such that players may strike the projectile from positions in front of, beside and behind any of the four elevated contact surfaces.

6. The elevated court sport set as set forth in claim 5 wherein said four elevated surfaces are adequate to withstand athletic play, player collisions and sharply struck kill shots of said heavy tennis ball type projectile and structure supporting such is of sufficient rigidity to withstand kill shots of said heavy tennis ball type projectile and frequent player collisions with said contact surfaces.

7. The elevated court sport set as set forth in claim 5 wherein said four elevated trapezoidal shaped contact surfaces have rounded corners.

8. The elevated court sport set forth in claim 5 wherein said four elevated contact surfaces are supported by a height adjustable supporting structure.

9. The elevated court sport set as set forth in claim 8 wherein said height adjustable supporting structure comprises a plurality of telescoping and lockable legs for each of said separate table tops.

10. The elevated court sport set as set forth in claim 9 wherein said four elevated contact surfaces are tilted by independently adjustable legs to provide for a greater angle of reflection when said tennis ball type projectile strikes it.

11. The elevated court sport set as set out in claim 10 wherein said four contact surfaces each comprise at least a half inch thick slab made to withstand 600 pounds of force.

12. The elevated court sport set as set out in claim 10 wherein said legs comprise aluminum or steel composite made to withstand 600 pounds of force.

* * * * *